US008774422B2

(12) United States Patent
Mischel, Jr. et al.

(10) Patent No.: US 8,774,422 B2
(45) Date of Patent: Jul. 8, 2014

(54) APPARATUSES AND METHODS FOR PLAYING HANDHELD MEDIA DEVICE SIGNALS

(75) Inventors: James V. Mischel, Jr., Seattle, WA (US); James V. Mischel, Sr., Seattle, WA (US); Joseph Bogdjalian, Glendale, CA (US); Maurice Wong, Lynnwood, WA (US)

(73) Assignee: Electric Mirror, LLC, Everett, WA (US)

( * ) Notice: Subject to any disclaimer, the term of this patent is extended or adjusted under 35 U.S.C. 154(b) by 1185 days.

(21) Appl. No.: 12/587,635

(22) Filed: Oct. 9, 2009

(65) Prior Publication Data

US 2010/0290640 A1 Nov. 18, 2010

Related U.S. Application Data

(60) Provisional application No. 61/216,106, filed on May 13, 2009.

(51) Int. Cl.
*H04R 1/02* (2006.01)

(52) U.S. Cl.
USPC ..... 381/87; 381/386; 381/333; 381/388

(58) Field of Classification Search
CPC ..... H04R 1/02; H04R 1/025; H04R 1/04; H04R 5/02; H04R 2205/022; B60R 11/00; B60R 11/02; B60R 11/0205; B60R 11/0252; H04S 3/00; H04B 10/1149
USPC ..... 381/87, 300, 333, 334, 335, 336, 386, 381/387, 388, 395; 361/683, 686; 700/94; 398/130
See application file for complete search history.

(56) References Cited

U.S. PATENT DOCUMENTS

| | | | | |
|---|---|---|---|---|
| 2006/0250764 | A1 * | 11/2006 | Howarth et al. | 361/683 |
| 2007/0230723 | A1 * | 10/2007 | Hobson et al. | 381/300 |
| 2008/0212971 | A1 * | 9/2008 | Shaanan et al. | 398/130 |
| 2008/0278899 | A1 * | 11/2008 | Hotelling et al. | 361/683 |
| 2009/0009957 | A1 * | 1/2009 | Crooijmans et al. | 361/686 |

* cited by examiner

*Primary Examiner* — Vivian Chin
*Assistant Examiner* — Friedrich W Fahnert
(74) *Attorney, Agent, or Firm* — Peloquin, PLLC; Mark S. Peloquin, Esq.

(57) ABSTRACT

An apparatus includes a support unit for a handheld media device. The support unit has a first surface and a second surface. The first surface is coupleable to a substantially planar object. The substantially planar object is configured for mounting in a vertical position. The second surface is sized to support the handheld media device when the handheld media device is placed thereon.

34 Claims, 8 Drawing Sheets

APPARATUSES AND METHODS FOR PLAYING HANDHELD MEDIA DEVICE SIGNALS

RELATED APPLICATIONS

This patent application claims priority from commonly assigned U.S. Provisional Patent Application Ser. No. 61/216,106 filed on May, 13, 2009.

U.S. patent application Ser. No. 11/563,119, filed on Nov. 24, 2006; U.S. Provisional Patent Application No. 60/739,156, filed Nov. 23, 2005; U.S. Provisional Patent Application No. 60/739,399, filed on Nov. 23, 2005; U.S. Provisional Patent Application No. 60/794,209, filed on Apr. 21, 2006; and U.S. Provisional Patent Application Ser. No. 61/216,106 filed on May, 13, 2009 are hereby incorporated by reference into the present application.

BACKGROUND OF THE INVENTION

1. Field of Invention

The invention relates generally to accessories for handheld media devices, and more specifically to apparatuses and methods for playing a media signal from a handheld media device.

2. Art Background

Handheld media devices, such as the iPod® or iPhone® from Apple Computer, Inc., the Zune® from Microsoft, Inc. or any of the other handheld media devices, generically referred to as MP3 players, have proliferated in use and have become ubiquitous among the population. People use handheld media devices as personal portable entertainment centers. While on travel for business or pleasure, handheld media devices are used to play music and to watch video. By the very nature of the device, a handheld media device has a small screen and it can be difficult for some people to see what is displayed on the device's small screen. This can present a problem.

Handheld media devices rely on external speakers, such as headphones, to enable a user to hear an audio media signal. Listening to an audio media signal by means of headphones places a limitation on a user. For example, when a user is in a bathroom and the user wants to wash his or her face or to take a bath or shower, using a headset can be problematic and in some cases can render inoperable the headset or ruin the handheld media device. In another instance, when a user is in a general room, e.g., living room, study, dining room, hotel room, etc. headphones place a limitation on the user as well as other people in the vicinity of the user who might be able to hear the music but cannot due to the limitation of headphones. All of this can present problems.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

Apparatuses and methods are described for supporting a handheld media device on a substantially planar object, thereby allowing the media device to input a media signal into a sound system incorporated into the substantially planar object. In one or more embodiments, a handheld media device such as an MP3 player and a sound system for playing media content therefrom is incorporated into a substantially planar object such as a wall or a mirror.

Figure 1A:
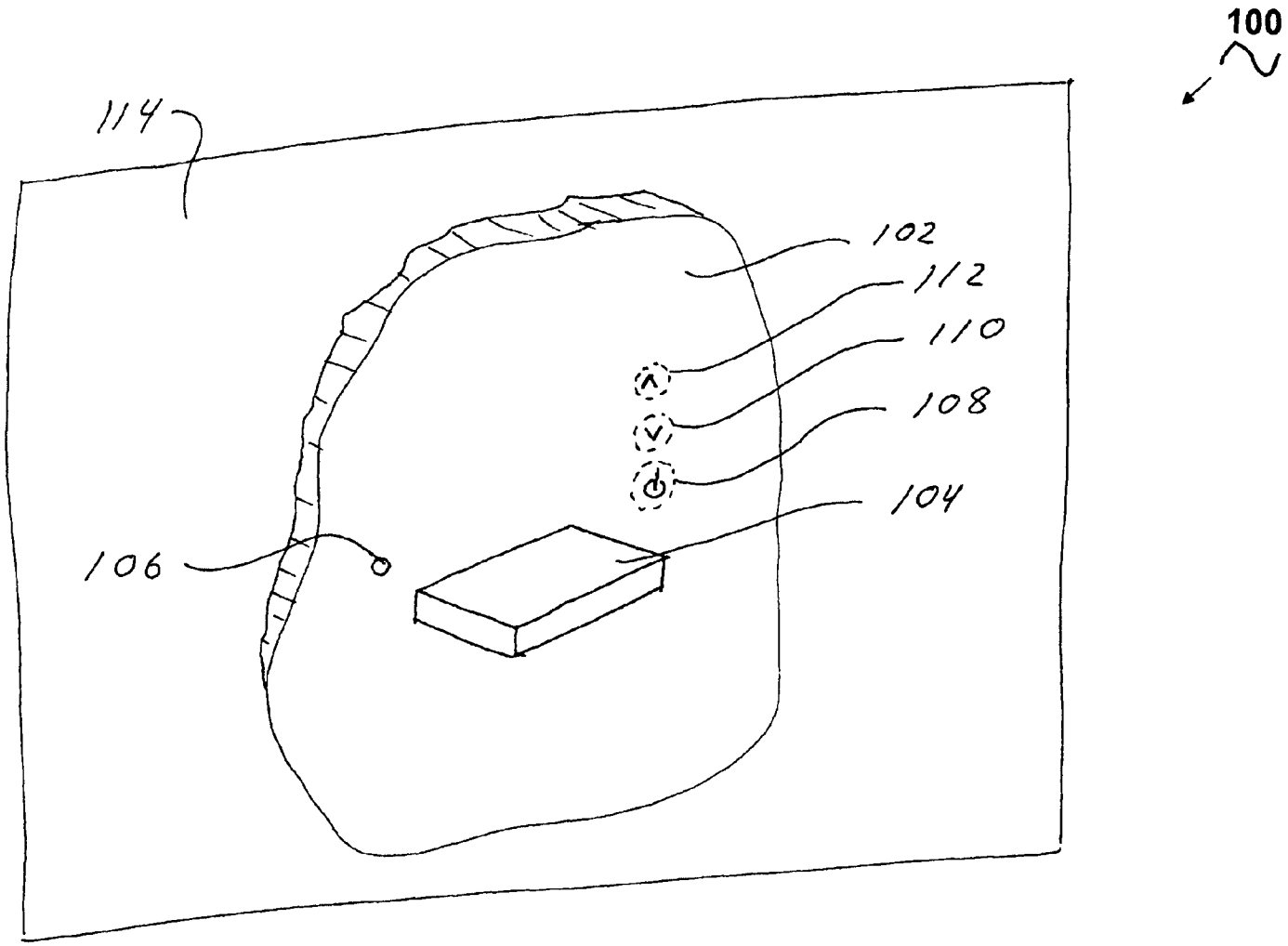
FIG. 1A illustrates an apparatus, with which a handheld media device can be supported and played, according to one embodiment of the invention.

FIG. 1A illustrates, generally at 100, an apparatus, with which a handheld media device can be supported and played, according to one embodiment of the invention. With reference to FIG. 1A, a substantially planar object 102 is configured for mounting in a vertical position, such as on a vertical surface 114. The substantially planar object 102 is shown in cut-away view, thus the outer perimeter of the substantially planar object 102 can assume any shape. The vertical surface 114 can be a wall of a dwelling space such as a wall of a house, a condominium, an apartment, an office, a cabin, a boat, etc. Alternatively, the substantially planar object 102 can be mounted in a vertical position by attachment to a piece of furniture (not shown) such as a dresser, such that the substantially planar object 102 functions as a mirror attached to the dresser. No limitation is placed on the type of vertical surface that can be used with embodiments of the invention. When embodiments of the invention are used with a wall or a component of a room, the wall can be a bathroom wall, a living room wall, a den wall, a door, etc., no limitation is placed on the vertical surface.

In one or more embodiments of the invention, the substantially planar object 102 will be a mirror, such as a bathroom mirror mounted on the wall of a bathroom. The bathroom mirror can be mounted on a wall, built into a wall, or the bathroom mirror can be incorporated into a door of a medicine cabinet. In another embodiment, the substantially planar object 102 is a piece of art glass. In another embodiment, the substantially planar object 102 is ceramic art. In another embodiment, the substantially planar object 102 is a combination of materials such as fabric and glass. In another embodiment, a substantially planar object is a wall or a part of a wall. In yet another embodiment, a substantially planar object is a glass wall or a part of a glass wall. Many different combinations of materials are used to create a variety of substantially planar objects for use with embodiments of the invention.

As used in this description of embodiments, the term "substantially planar object" will be understood to include planar objects such as a mirror, a flat glass surface, a glass wall, part of a glass wall, a wood wall, a wall made from sheet rock, etc. The term "substantially planar object" will also be understood to include objects that are not as planar as the foregoing but convey the impression of being substantially planar, such as a piece of art glass that is not as flat as a mirror surface but is textured; a ceramic surface that is textured, a wood surface, a sculpture, etc. It will be recognized by those of skill in the art that such textures in a surface or a sculpture can be quite thick, on the order of several inches to a foot or more in depth. Embodiments of the invention are not limited by the details of a substantially planar object and can be incorporated into all manner of substantially planar objects. Thus, the examples provided herein are provided for illustration purposes only and should not be construed to limit the embodiments.

A support unit 104 is configured to be mountable to the substantially planar object 102. The support unit 104 is sized to support a handheld media device, when the handheld media device is placed thereon. Handheld media devices are shown below in the figures that follow such as FIG. 2, FIG. 3, FIG. 4, and FIG. 5 but are not shown in FIG. 1A for clarity of illustration. Any handheld media device can be supported by the support unit 104. Handheld media devices are known by various brand names such an iPod® and an iPhone® from Apple Computer, Inc., a Zune® from Microsoft, Inc., etc. A common generic name for a handheld media device is an MP3 player. However, no limitation is implied by use of the MP3 designation in this way. In this detailed description of embodiments, the term "handheld media device" will be understood to encompass all such devices and at times, such devices will be used to output or to "play" various "media signals," such as audio, video, or a combination of audio and video. The embodiments of the invention described herein are not limited by media type but are adapted for use with the various media that handheld media devices can record and play.

A signal connection 106 is provided, into which a signal from a handheld media device can be input, controlled, and then played on speakers for the enjoyment of a user, according to embodiments of the invention. Power is provided to an amplification system by a control 108. A user adjusts the volume of the audio signal that is played by embodiments of the invention by a volume control 110 and 112. A volume control 112 is used to increase volume and the volume control 108 is used to decrease volume. Alternatively, a single control can be provided to both increase and decrease volume.

The controls 108, 110, and 112 are implemented by using various technologies. In one embodiment, capacitance touch technology is used to provide a control that appears "built-into" the surface. With such technology, the surface of the substantially planar object 102 is marked to indicate where the controls are located. Alternatively, membrane technology is used to provide controls, in yet another embodiment a control is provided through the use of an optical sensor. In yet another embodiment, a rotating shaft type of control is provided. In yet another embodiment, a push button control is employed. No limitation is implied by the type of control employed within various embodiments of the invention.

A hole is created in the substantially planar object 102 and the signal connection 106 is placed therein. In one or more embodiments, the signal connection 106 is a jack for a 3.5 millimeter audio connector. In such an implementation, a cable is used to connect a headphone jack from a handheld media device to the signal connection 106.

Figure 1B:
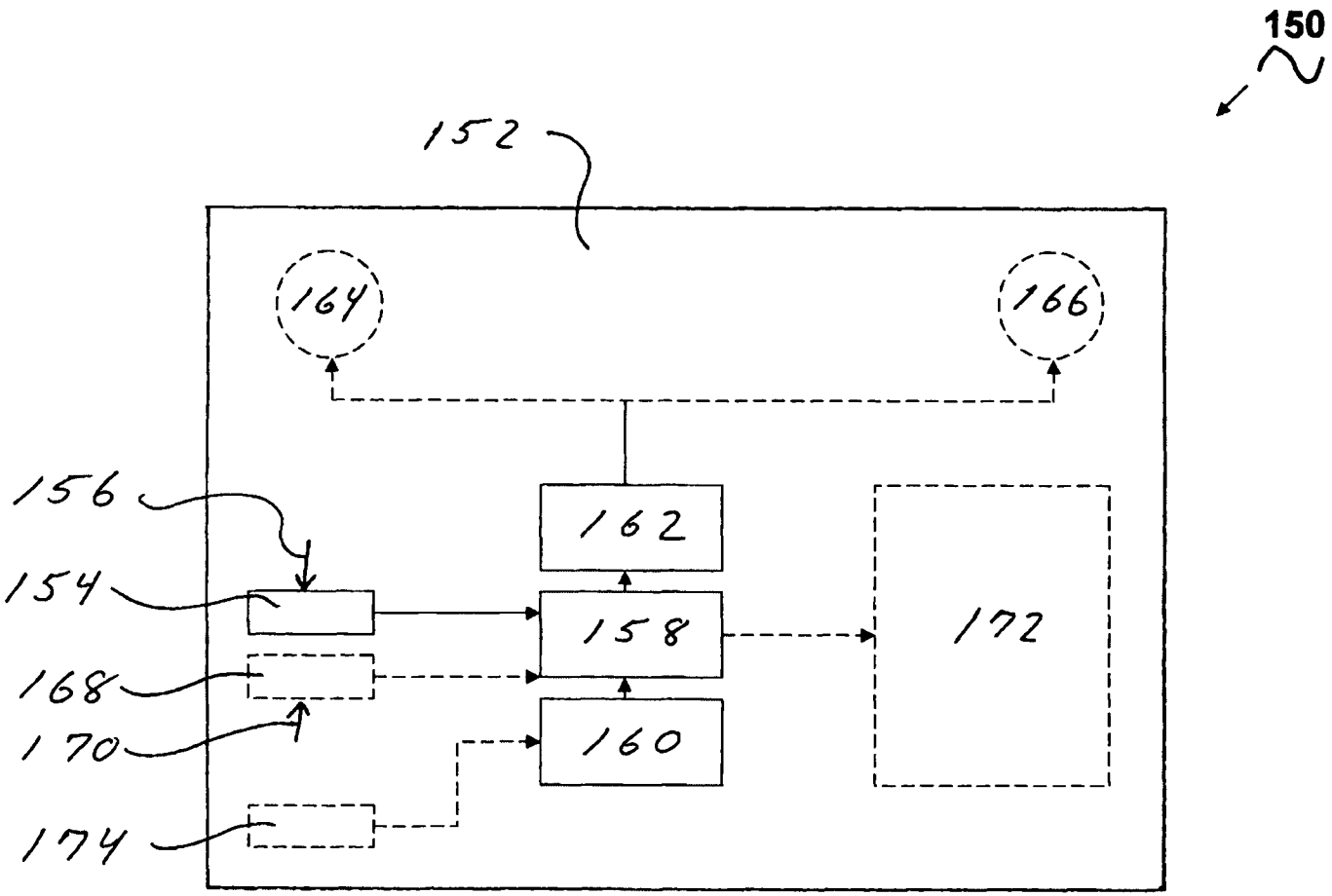
FIG. 1B illustrates a block diagram for a system employing embodiments of the invention.

FIG. 1B illustrates, generally at 150, a block diagram for a system employing embodiments of the invention. With reference to FIG. 1B, a substantially planar object 152 of general size is illustrated therein. A signal connection 154 is configured to receive a media signal 156 from a handheld media device (not shown) when the handheld media device is placed on a support unit (not shown) such as the support unit 104 shown in FIG. 1A. A source of power 160 is used with the signal 156 by the control circuit 158 to feed an amplifier 162. The output of the amplifier 162 drives speakers 164 and/or 166. Speakers 164 and/or 166 can be located within the substantially planar object 152, on the substantially planar object 152, or the speakers 164 and/or 166 can be externally located from the substantially planar object 152. For example, the speakers 164 and/or 166 could be located in a ceiling of a room where the substantially planar object is located. Or the speakers 164 and/or 166 could be located in a wall or surface that the substantially planar object is mounted to.

In various embodiments, the signal connection 154 is a dock for a handheld media device. In such a situation, the dock can input a media signal that contains audio, video or audio and video into the control circuit 158. An optional display screen 172 can be incorporated into the substantially planar object and in such a case the control circuit 158 can cause a signal to be sent to the display screen for display thereon. If a corresponding audio signal exists, then the audio can be broadcast on the speakers 164 and/or 166. Optionally, one or more speakers can be located with the display screen 172.

In one or more embodiments, the substantially planar object 152 is a mirror and the reflectivity of the mirror can be adjusted in the region where the display screen 172 is located to permit the display screen 172 to be invisible when powered off and visible when powered on. Such adjustments to the reflectivity of a mirror surface are taught in commonly assigned U.S. patent application Ser. No. 11/563,119, filed on Nov. 24, 2006, which is incorporated herein for reference.

Optionally, a second signal connection 168 is provided to receive a signal 170. In such a configuration, signal connection 154 can be an audio input and the signal connection 168 is the dock for the handheld media device through which both audio and video signals are input and through which a battery in the handheld media device can charge.

In various embodiments, the composition of the control circuit 158 will vary depending on whether a support unit is provided with a dock or whether the support unit is designed to function only with a signal connection designed to receive a headphone output signal from a handheld media device. For example, when a signal connection such as 168 includes a dock for a handheld media device such as an Apple® iPod®, iPhone®, Microsoft® Zune®, etc., the control circuit is capable of communicating with the handheld media device. Further discussion pertaining to a dock for a handheld media device is provided below in conjunction with FIG. 4.

An optional Universal Serial Bus (USB) connection is provided at 174. The optional USB connection can be used to charge a second handheld media device. Additionally, the USB connector can be used to charge a battery in a handheld media device that is meant to connect in the dock but has an inoperative mating dock connector on the handheld media device. Thus, the USB connector can serve as an auxiliary means of charging a handheld media device.

In another embodiment, a substantially planar object 152 is mounted in a vertical orientation such as for example as a wall or a part of a wall. Such a wall 152 can be incorporated into any portion of a building, such as but not limited to into a room of a house, an office, an apartment, a hotel room, etc. In one or more embodiments, the wall 152 is a glass wall or a part of a glass wall in a bathroom of a hotel, a house, an office, etc. In one or more embodiments, the glass wall 152 is a mirror wall. Incorporated into the mirror wall 152 is a signal connection 154. The signal connection 154 is inserted into a hole in the glass and in one or more embodiments the signal connection is a jack for a 3.5 millimeter audio cable configured for use with a headphone jack connector, which is supplied on handheld media devices.

The signal connection 154 is electrically coupled to a control circuit 158. A source of electrical power 160 is supplied to the control circuit 158 and the control circuit 158 is electrically coupled to an amplifier 162. The output of the amplifier 162 provides an input signal to a speaker 164 and/or speaker 166. Speakers 164 and/or 166 may or may not be part of the system 150. For example, in one embodiment, the speakers 164 and/or 166 can be located externally from the wall 152. The control circuit 158 includes a volume control, with which a user can adjust the volume of a media signal (audio signal) that is played by the system 150. An optional power control can be included in the control circuit 158. When provided, the power control can be operated by the user to connect or disconnect the source of power 160 from the control circuit 158. Such a feature can be used to save energy.

A display screen 172 can optionally be included in the wall 152. When the display screen 152 is included in the system of 150, the display screen 152 is connected to the control circuit 158 and can be used to display a media signal (audio and video) from a handheld media device. As described above, the wall 152 can be a mirror wall. In one or more embodiments, the reflectivity of the mirror can be adjusted in the region where the display screen 172 is located to permit the display screen 172 to be invisible when powered off and visible when powered on. Such adjustments to the reflectivity of a mirror surface are taught in commonly assigned U.S. patent application Ser. No. 11/563,119, filed on Nov. 24, 2006, which is incorporated herein for reference.

Figure 1C:
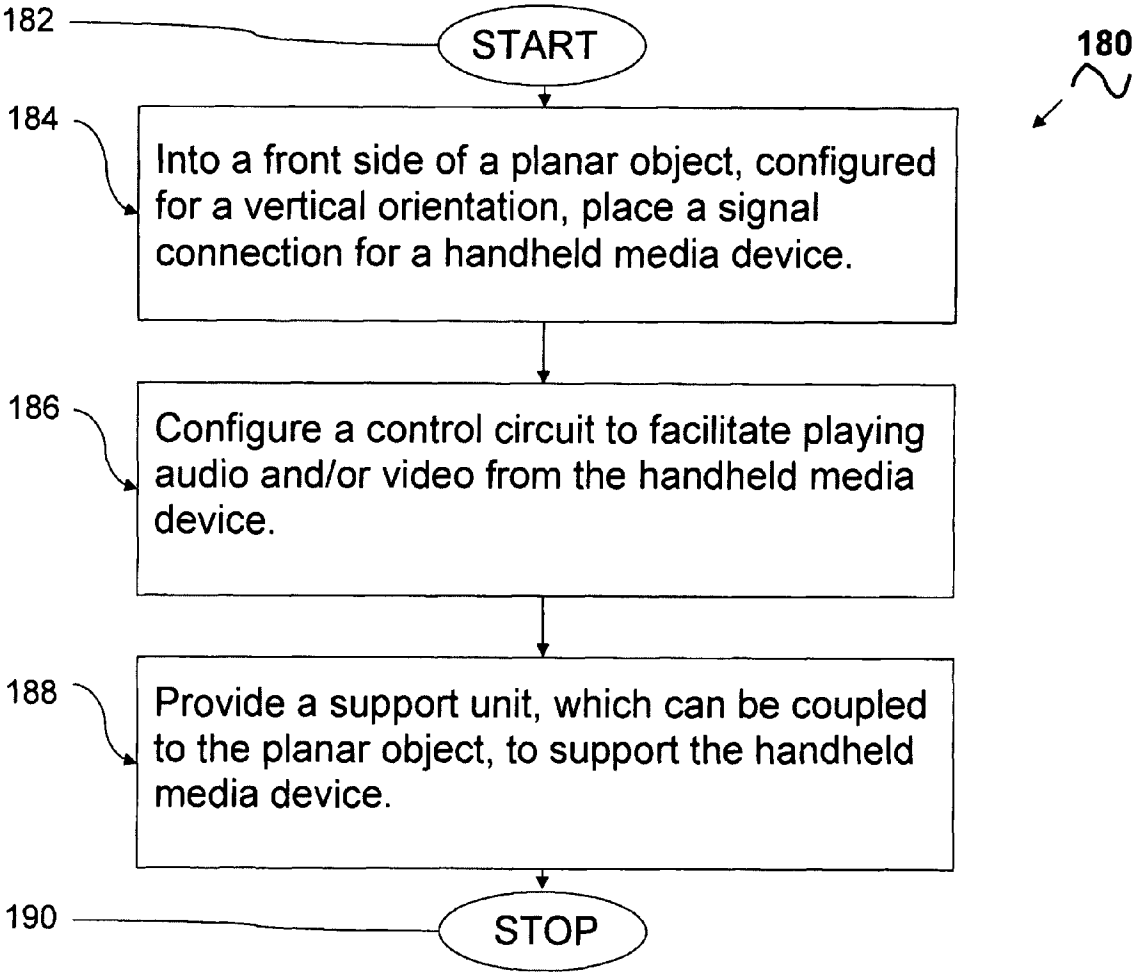
FIG. 1C illustrates a method usable with embodiments of the invention.

FIG. 1C illustrates, generally at 180, a method that is usable with embodiments of the invention. With reference to FIG. 1C, a method starts at a block 182. At a block 184 a substantially planar object is configured with a signal connection, through which a signal from a handheld media device can be received. At a block 186, a control circuit is provided to play audio and/or video from a handheld media device. At a block 188, a support unit for a handheld media device is provided which can be coupled to the substantially planar object. The process concludes at a block 190.

Figure 2:
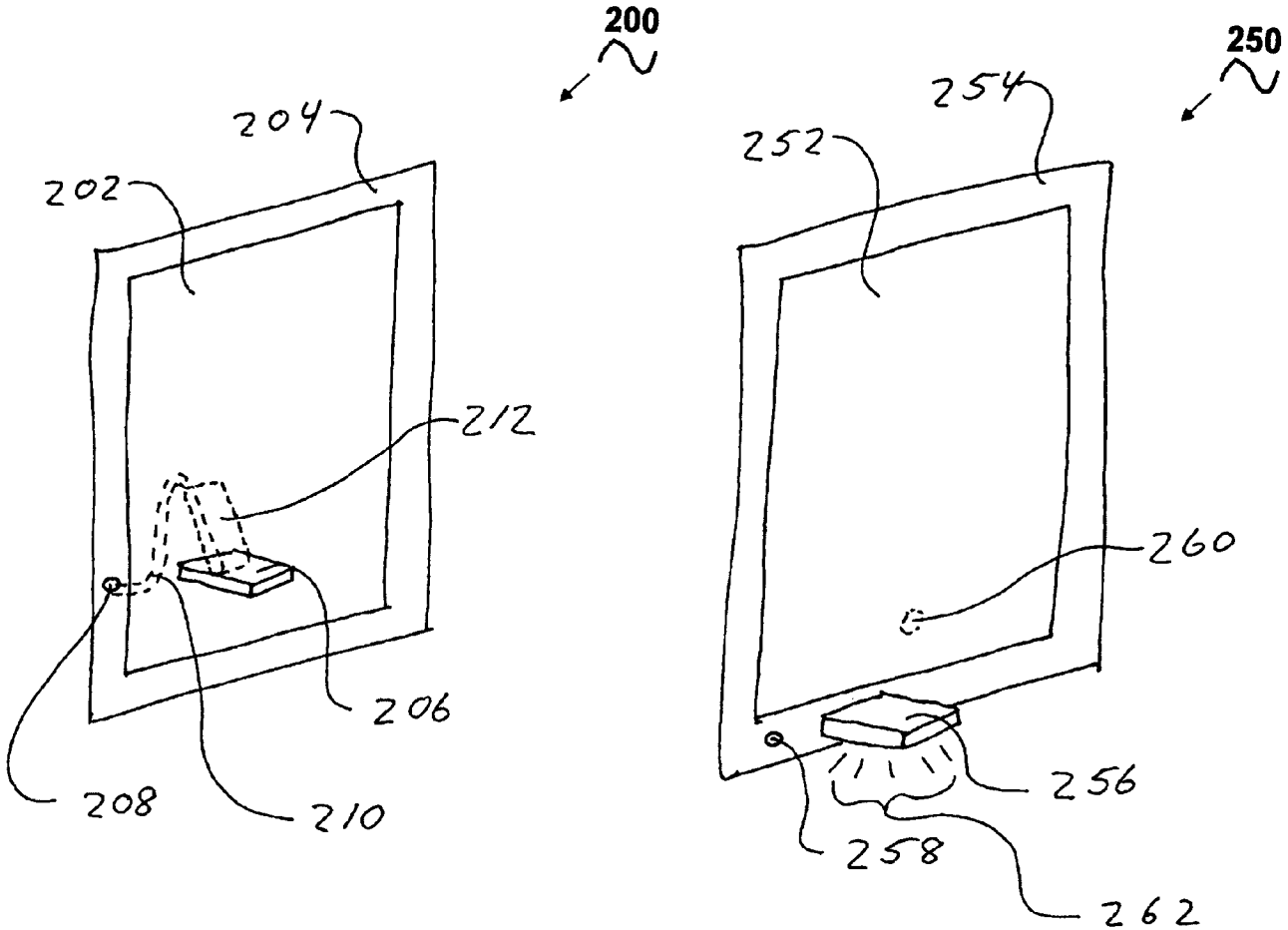
FIG. 2 illustrates different mounting locations according to embodiments of the invention.

FIG. 2 illustrates different mounting locations according to embodiments of the invention. With reference to FIG. 2, at 200 in one embodiment, a mirror 202 is illustrated. The mirror has an optional frame indicated at 204. Either individually or collectively the mirror 202 and or the frame 204 provide the substantially planar object. A support unit 206 for a handheld media device 212 is coupled to the mirror 202. A signal connection 208 is provided in the frame of the mirror 204. A cable 210 provides a path for a media signal from the handheld media device 212 to enter a system having the functionality of the system 150 described in conjunction with FIG. 1B above with which the media signal is capable of being broadcast for hearing and/or viewing by a user.

In an alternative configuration shown in 250, another embodiment is presented where a mirror 252 has a frame 254 and a signal connection 258 is provided therein. A support unit 256 is coupled to the frame 254 instead of the mirror 202 as was shown at 200. Alternatively, a signal connection is provided at 260 (within the glass of the mirror 252). In one or more embodiments, the signal connection 260 is placed within a hole in the mirror. In one or more embodiments, the signal connection is a jack for a 3.5 millimeter audio cable. In one embodiment, light 262 emanates from the underside of the support unit 256. The light 262 can provide a night light for a user. Note that the planar surface represented by the mirror 252 and the frame 254 could have been a different item such as an art glass decoration or some other substantially planar object from which the support unit 256 can be attached. Such a substantially planar object can be hung on the wall in a hallway, room, etc. and the light 262 can be triggered by a sensor that senses the level of ambient light and turns the light on when a preset ambient light condition occurs. In such an embodiment, the light sensor is part of the control circuit such as that described in conjunction with FIG. 1B at 150.

Figure 3:
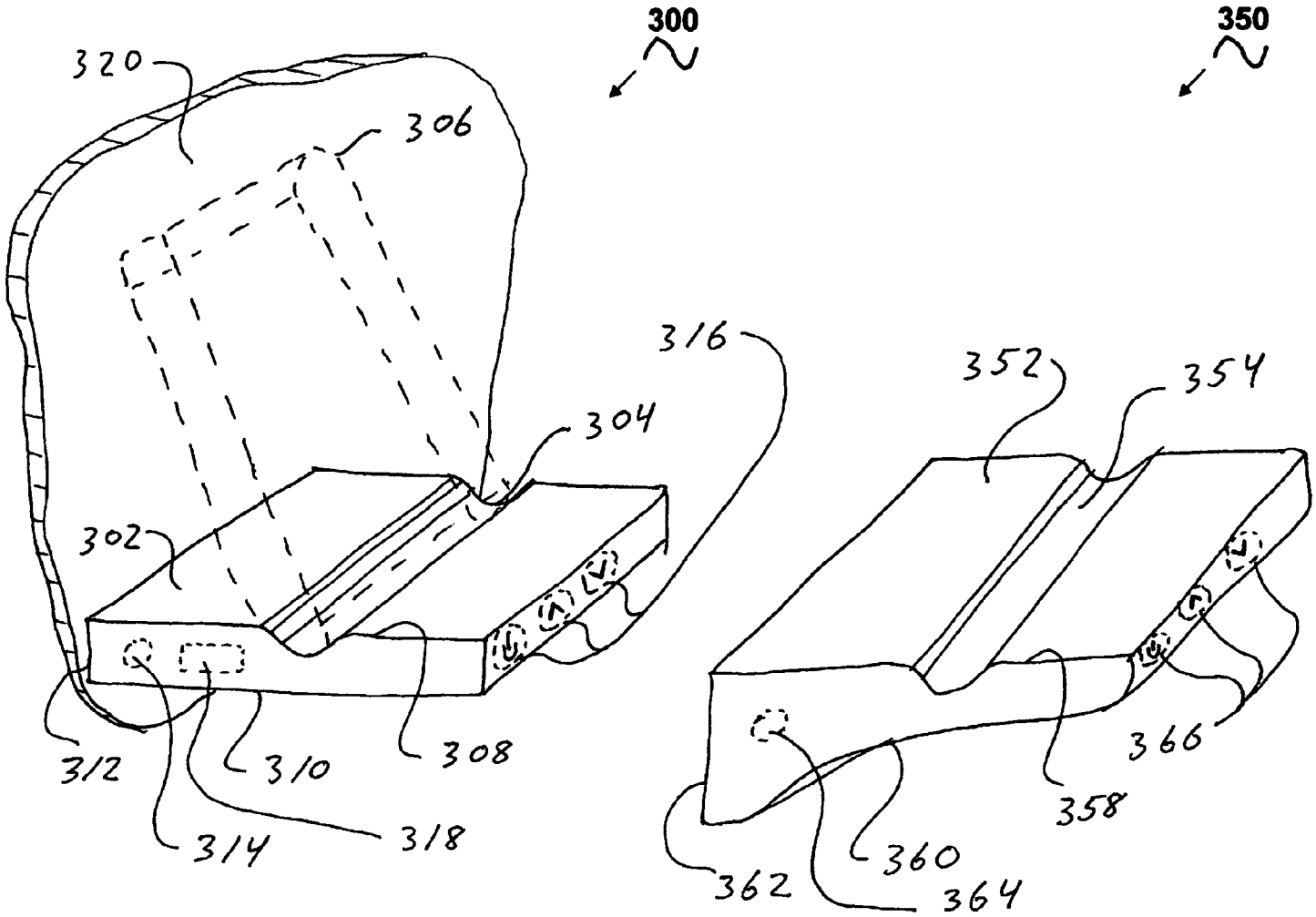
FIG. 3 illustrates variations in a support unit for a handheld media device, according to embodiments of the invention.

FIG. 3 illustrates variations in a support unit for a handheld media device, according to embodiments of the invention. With reference to FIG. 3 at 300, a support unit 302 is configured with a groove 304 and the support unit 302 is attached to a substantially planar object 320 along a first surface 312. A handheld media device 306 is supported by the groove 304 and rests against the substantially planar object 320. The groove 304 is useful to permit the handheld media device 306 to rest against the substantially planar object 320 without slipping off the support unit 302 and sustaining damage from a fall therefrom.

Optionally, a signal connection 314 is provided in the support unit 302. In one embodiment, the signal connection 314 is a universal audio connection utilizing the 3.5 millimeter standard. An optional universal serial buss (USB) connector 318 is provided from which a battery within a handheld media device can be charged. Controls 316 for power and volume are configured with a system as described in conjunction with FIG. 1B thereby permitting a user to adjust the volume of a signal played via the signal connection 314.

A support unit can be implemented in a variety of different designs. For example, in one embodiment, a shape of the support unit 302 is substantially rectangular with a second surface 308 and a third surface 310 being arranged substantially parallel to each other. An example of a tapering profile in thickness of a support unit is seen in the design presented at 350 by a support unit 352. The support unit 352 is coupled to a substantially planar object (not shown) along a first surface 362. The support surface 352 has a groove 354 in a second surface 358. A handheld media device (not shown for clarity); however, similar to 306 at 300 is supported in the groove 354. Optionally, a signal connection 364 is provided to receive an audio signal from a handheld media device. Controls 366 include a power control and a volume control for turning an amplifier system on and off and for adjusting the volume of an audio media signal as the signal is input to speakers for broadcast to a user. In the design of the support unit 352, presented at 350, the second surface 358 and the third surface 360 are non-parallel, being further apart at the first surface 362 and narrowing toward the end where controls 366 are attached.

The controls 316 or 366 can also provide a source of light that emanates therefrom. Such as source of light can provide a night light for a user.

The support units, such as those illustrated in the previous figures, e.g., at 104 in FIG. 1A, 206, and 256 in FIG. 2, etc., can be manufactured in a variety of ways, using solid pieces of glass, which in some embodiments are ground and drilled to receive grooves, signal connections, controls, etc. or the support unit can be made from several pieces of material such as plastic, metal, etc. as will be described below in conjunction with the figures that follow.

Figure 4:
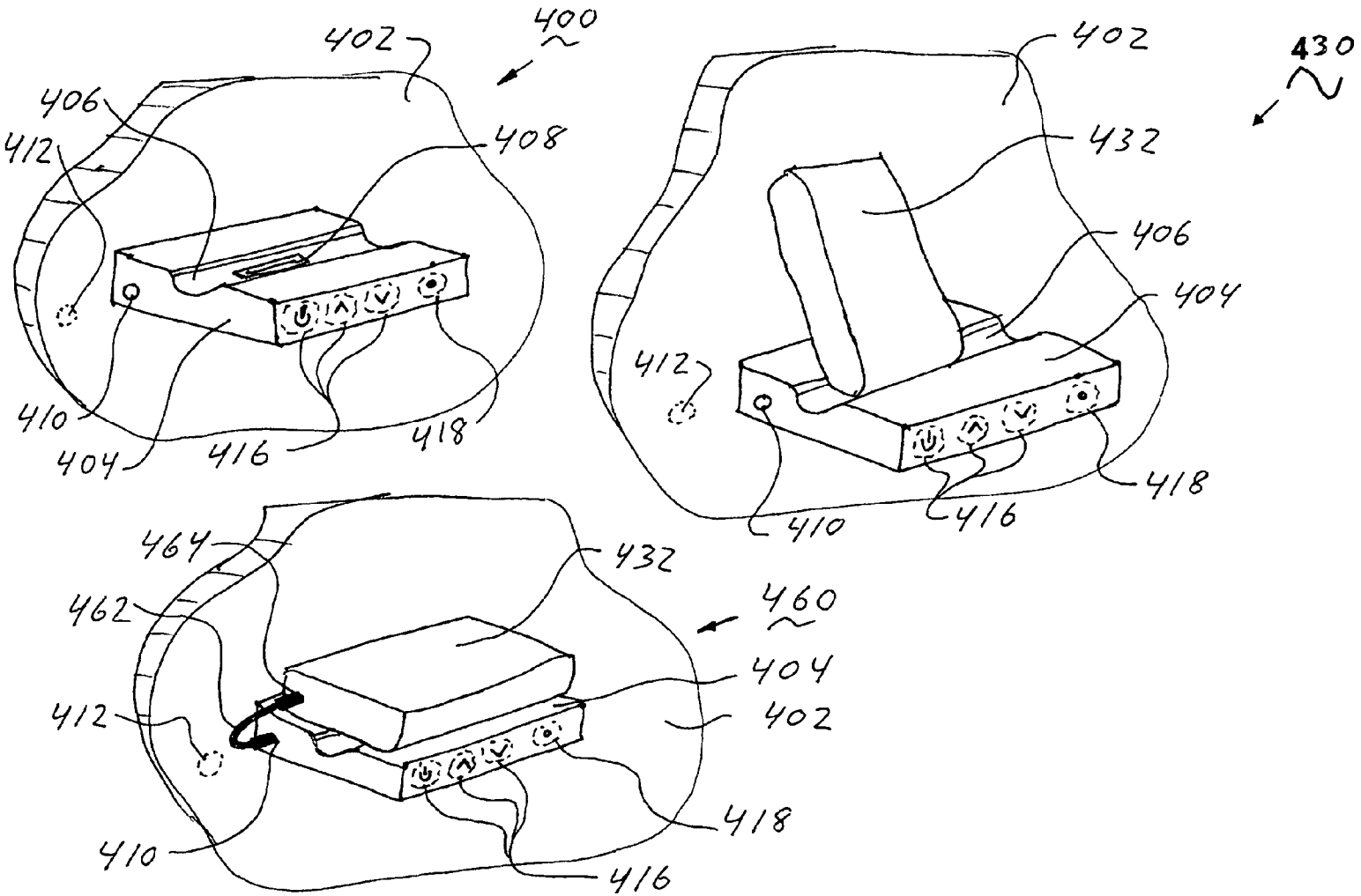
FIG. 4 illustrates a support unit that includes a dock for a handheld media device, according to embodiments of the invention.

FIG. 4 illustrates a support unit that includes a dock for a handheld media device, according to embodiments of the invention. With reference to FIG. 4, at 400, a support unit 404 is coupled to a substantially planar object 402 along a first surface of the support unit 404. Similar to the description above in conjunction with the preceding figures, only a part of the substantially planar object 402 is shown in FIG. 4 since the substantially planar object 402 can have a general shape, such as but not limited to square, rectangular, circular, baroque, etc. For the purpose of this description of embodiments it will be understood that the portion of the substantially planar object so displayed at 402 encompasses all such variations in size/shape.

The support unit 404 has a groove 406 along a second surface or top side of the support unit 404. Within the groove 406 is a dock 408 which is connected to a control circuit such as the one described in conjunction with FIG. 1B. The dock 408 provides a signal connection between a handheld media device and a control circuit configured to communicate with the handheld media device. The dock 408 is used to connect a handheld media device to a control circuit so that an audio and or a video media signal can be received (amplified as desired by a user) and then output to speakers and a media display screen when video is part of the media signal. Additionally, the dock 408 provides a source of electrical power that charges a battery within a handheld media device when the handheld media device in placed in the dock 408.

The electrical interface requirements for a dock and the mechanical requirements for a dock connector are specific to a particular make and model of a handheld media device's connector and communication protocol. Such information is readily available to those of skill in the art for the various handheld media devices that are commercially available. For example, as is known to those of skill in the art, Apple® has implemented a licensed developer program to permit the design and development of accessories that work with the iPod® and the iPhone®. Apple® supplies licensed developers with technical specifications describing the required connectors, components, and detailed documentation on the communication protocol used to interact with the iPhone® and iPod®. The program can be joined by contacting Apple® at madeforipod@apple.com. For the iPod®, Apple® uses connectors made by Japan Aviation Electronics Industry, Ltd. (JAE), connector series DD1 can be seen at the following universal resource locator (URL) on the Internet: "http://www.jae-connector.com/en/general_en.cfm?series_code=DD1&contact_number=&s_height=&1_con=&r_con=."

In one embodiment, a signal connection 410 is provided in the support unit 404. Optionally, a signal connection 412 can be located in the substantially planar object 402 in place of or in addition to the signal connection 410. The signal connection 410 and the signal connection 412 are designed to receive a 3.5 millimeter connector from a cable that plugs into the headphone jack on handheld media devices. The 3.5 millimeter headphone connector is a standard across handheld media devices.

Configured with a dock 408 and a 3.5 millimeter signal connection at 410 and/or 412, the support unit can accommodate both the handheld media device that the dock 408 is designed for as well as any handheld media device that has a 3.5 millimeter headphone connection. In FIG. 4 at 430 a handheld media device 432 is illustrated being supported by the support unit 402 and connected via the dock 408. Alternatively, at 460 in FIG. 4, the handheld media device 432 can be connected via its headphone connector 464 with an audio cable 462 to either the signal connection 410 or 412.

Controls 416, for power and volume, are provided on a front surface of the support unit 404. Controls 416 provide power to a control circuit and allow a user to adjust the volume of the audio that can be heard on speakers (not shown) when a handheld media device is outputting a media signal. A video control 418 can be used when the handheld media device is connected to a dock, such as 408, and is outputting a video signal. The video control 418 can be used in conjunction with a display screen, such as that illustrated at 172 in FIG. 1B.

Figure 5:
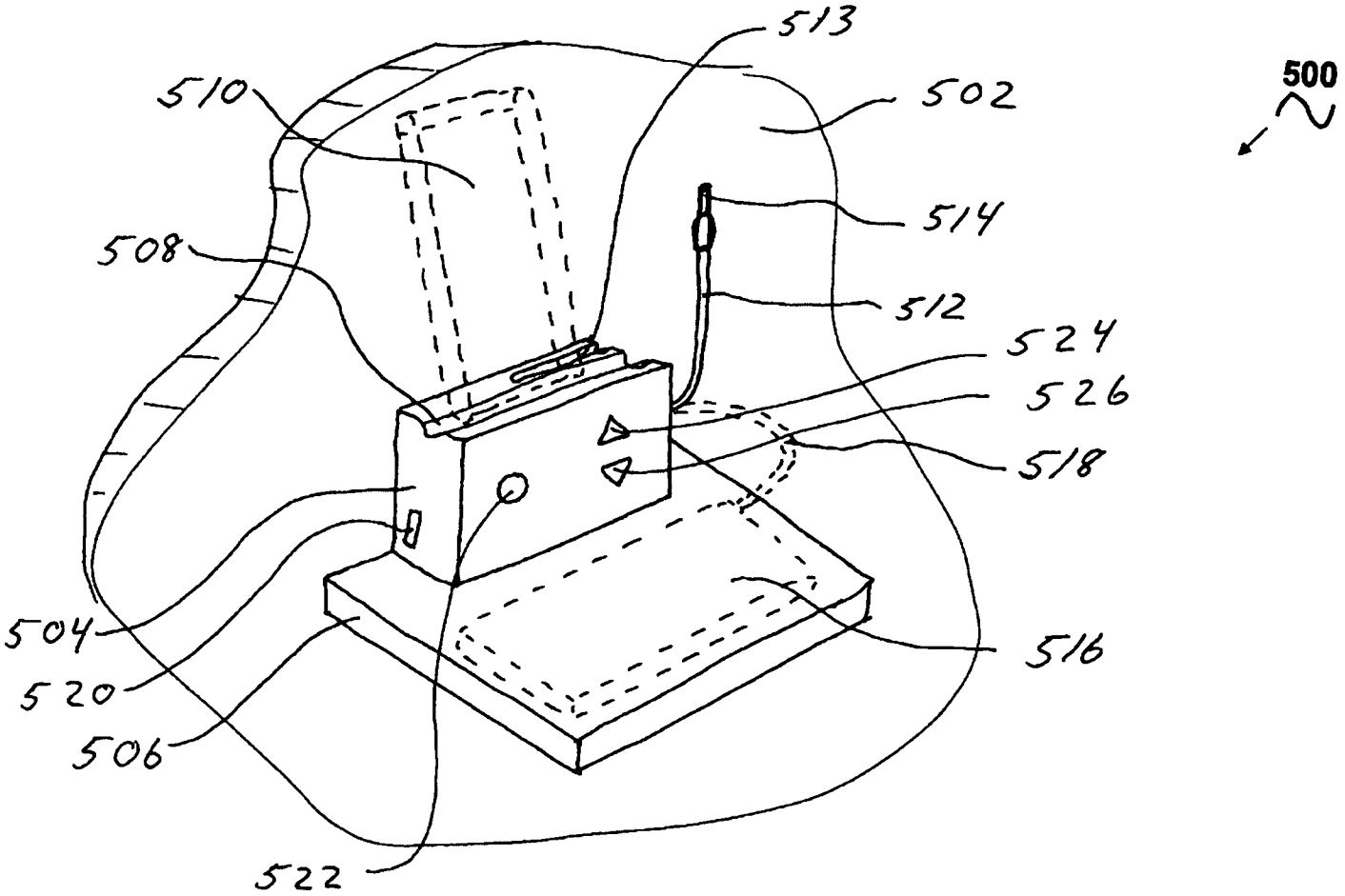
FIG. 5 illustrates a support unit that provides multiple positions with which to support a handheld media device, according to embodiments of the invention.

FIG. 5 illustrates, generally at 500, a support unit that provides multiple positions with which to support a handheld media device according to embodiments of the invention. With reference to FIG. 5, a partial view of a substantially planar object 502 is illustrated. As discussed above, the substantially planar object 502 can have a variety of shapes; no limitation is intended with respect to the overall shape of the substantially planar object, therefore a partial view is shown for illustration purposes and no limitation is intended thereby.

A support unit 504 is coupled to the substantially planar object 502. An extension 506, of the support unit 504, provides another location on which to support a handheld media device 516. The extension 506 provides a shelf-like surface for support. A second position for support is illustrated by the handheld media device 510 resting in a groove 508. Optionally, the groove 508 can contain a dock for a handheld media device as discussed above in conjunction with the preceding figures.

In one embodiment, the support unit 504 has a signal cable 512 attached thereto. The signal cable 512 has a connector 514 that is used to connect with a handheld media device. In one embodiment, the connector 514 follows the 3.5 millimeter standard for headphones; in such a case, the connector is plugged into a headphone jack on a handheld media device. The cable 512 inserted into the handheld media device 516 is indicated by a cable position 518. In one embodiment, the support unit 504 has a groove 513 in which the cable 514 can be stored. The groove 513 is illustrated on a top surface of the support unit 504; however the groove 513 can be placed in another side or in additional sides of the support unit 504. In one or more embodiments, the cable 512 is retractable and is stored within the support unit 504 or within the extension 506. In yet another embodiment, a jack for a 3.5 millimeter audio connector is supplied on the support unit 504 in place of the cable 512. In such a case, a user will use a separate cable with 3.5 millimeter plugs to make the connection between the handheld media device and the system's signal connection.

Controls are provided on the support unit to facilitate playing a media signal from the handheld media device. Controls are also used for adjusting the sound of the media signal along with a picture rendered from the media signal if a display screen is used in conjunction with the handheld media device and the media signal contains video. A power control is indicated at 522, which can turn a control circuit on and off. A volume control is indicated at 524 to increase volume and a volume control is indicated at 518 to reduce volume. Alternatively, a single volume control is provided in some embodiments. Optionally, the controls 522, 524, and 526 can be provided in another place such as on the substantially planar object 502. A universal serial bus (USB) connector is provided on the support unit 504 at 520. The USB connector provides a source of power with which a handheld media device's battery can be charged.

Figure 6:
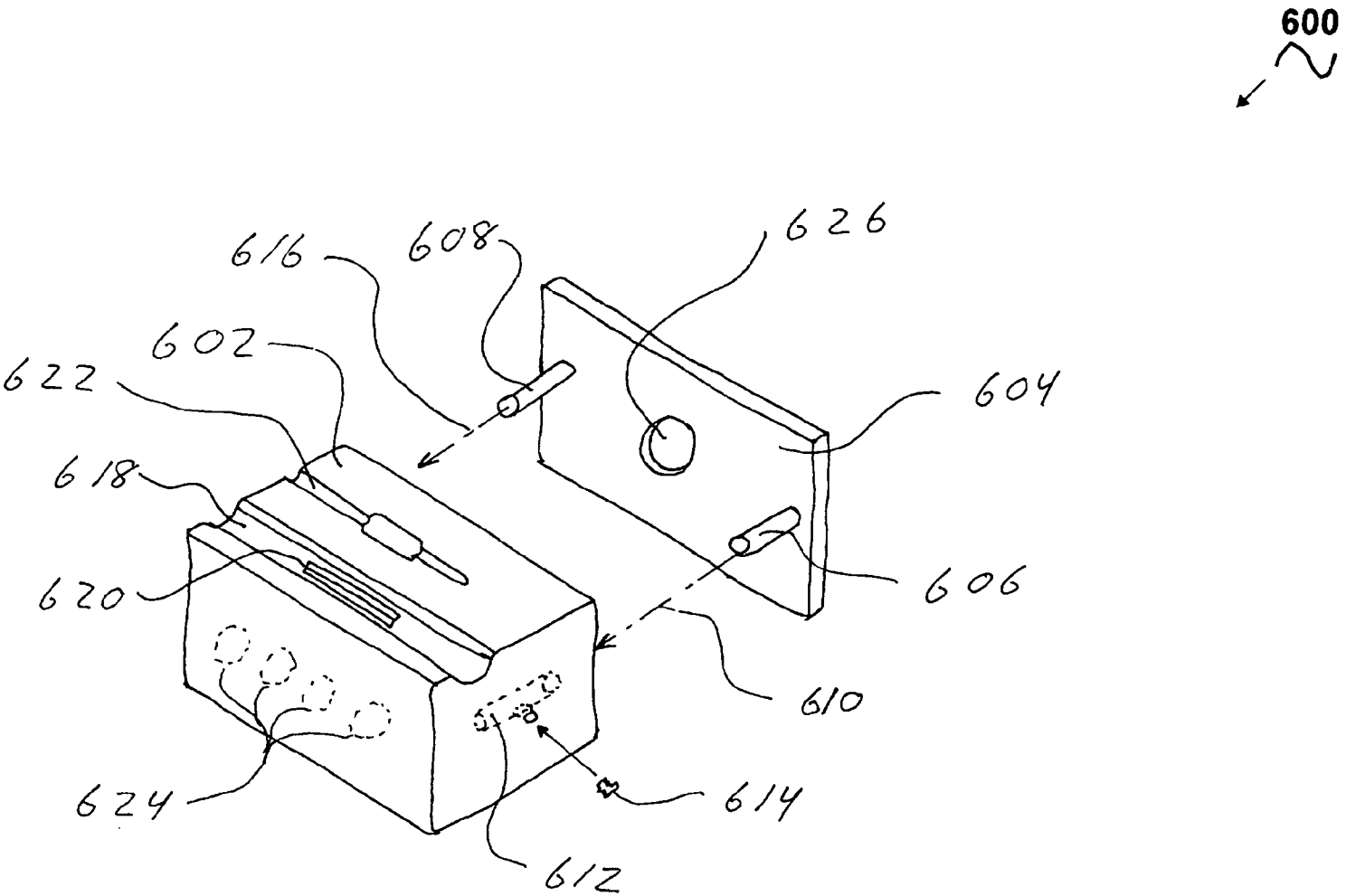
FIG. 6 illustrates an exploded view of a support unit, according to embodiments of the invention.

FIG. 6 illustrates, generally at 600, an exploded view of a support unit, according to embodiments of the invention. With reference to FIG. 6, a support unit has a front portion 602 and a back portion 604. The back portion 604 can be attached to a substantially planar object, such as, for example in one embodiment, the substantially planar object 152 from FIG. 1B (not shown in FIG. 6 for clarity of illustration). A hole 626 is provided in the back portion 604 to permit signal conductors, such as wires, coaxial cables, etc. to pass through the back portion 604 and a corresponding hole in the substantially planar object as needed according to the design and distribution of the sound and/or video system in a given embodiment.

The front portion 602 is connected to the back portion 604 by a cylindrical post 606 and 608. The cylindrical post 606 is inserted into a hole 612 in the front portion 602 along a path indicated at 610. In one embodiment, a small screw 614 fastens the front portion 602 tightly against the post 606. A similar fastening is accomplished with the cylindrical post 608 and the front portion 602.

A groove 618 is provided with a dock 620 in the front portion 602. A handheld media device can connect to the dock 620 and a media signal can be input to the system and can be played on speakers and/or a display screen depending on whether video is present. Alternatively, a media signal can be obtained from a handheld media device through, in various embodiments, the headphone jack which is provided on handheld media devices. A storage groove is provided at 622 to store a cable suitable for connecting to the headphone jack, such as the cable illustrated at 512 in FIG. 5. Controls 624 are provided to control power, volume, and optionally picture for the media signal that the handheld media device can input into the systems taught in the embodiments presented herein.

In one or more embodiments, when a support unit is attached to a substantially planar object it can be difficult to remove the substantially planar object from the vertical surface that the substantially planar object is attached to. Or it might be desirable to remove the support unit from the substantially planar object. At times it might be desirable to remove part of the system to facilitate repair of a damaged component. In such a case, the two-piece design of a support unit 600 illustrated by the front portion 602 and the back portion 604 can facilitate the disassembly and repair of parts that are contained within the support unit 600. Additionally, the removal of the front portion 602 can provide access to the inside of the substantially planar surface through the hole 626. Such access can also be used to facilitate repair of parts of the system.

For purposes of discussing and understanding the embodiments of the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

While the invention has been described in terms of several embodiments, those of skill in the art will recognize that the invention is not limited to the embodiments described, but can be practiced with modification and alteration within the spirit and scope of the appended claims. The description is thus to be regarded as illustrative instead of limiting.

What is claimed is:

1. An apparatus comprising:

a support unit for a handheld media device, the support unit having a first surface and a second surface, the first surface is coupleable to and suspended from a substantially planar object, wherein the substantially planar object is configured for mounting in a vertical position, the second surface is sized to support the handheld media device when the handheld media device is placed thereon; and a signal connection, the signal connection receives a media signal from the handheld media device.

2. The apparatus of claim 1, wherein the signal connection is mounted in a hole in the mirror.

3. An apparatus comprising:

a support unit for a handheld media device, the support unit having a first surface and a second surface, the first surface is coupleable to and suspended from a substantially planar object, wherein the substantially planar object is configured for mounting in a vertical position, the second surface is sized to support the handheld media device when the handheld media device is placed thereon; and a signal connection, the signal connection receives a media signal from the handheld media device, wherein the support unit is configured with a front portion and a back portion, the back portion contains the first surface and is coupleable to the substantially planar object and the front portion is removeably coupleable with the back portion wherein the support unit is coupled to the substantially planar object, wherein the substantially planar object is a mirror and the support unit is mounted to a glass surface of the mirror.

4. The apparatus of claim 3, wherein the signal connection is mounted in a hole in the mirror.

5. An apparatus comprising:

a support unit for handheld media device, the support unit having a first surface and a second surface, the first surface is coupleable to and suspended from a substantially planar object, wherein the substantially planar object is configured for mounting in a vertical position, the second surface is sized to support the handheld media device when the handheld media device is placed thereon; and a signal connection, the signal connection receives a media signal from the handheld media device, wherein the support unit is configured with a front portion and a back portion, the back portion contains the first surface and is coupleable to the substantially planar object and the front portion is removeably coupleable with the back portion wherein the support unit is coupled to the substantially planar object, wherein the substantially planar object is selected from the group consisting of a mirror, a medicine cabinet door, art glass, ceramic, wood, a wall, part of a wall, a glass wall, part of a glass wall, and a wall decoration.

6. An apparatus comprising:

a support unit for a handheld media device, the support unit having a first surface and a second surface, the first surface is coupleable to and suspended from a substantially planar object wherein the substantially planar object is configured for mounting in a vertical position, the second surface is sized to support the handheld media device when the handheld media device is placed thereon; and a signal connection, the signal connection receives a media signal from the handheld media device, wherein the support unit is configured with a front portion and a back portion, the back portion contains the first surface and is coupleable to the substantially planar object and the front portion is removeably coupleable with the back portion wherein the support unit is coupled to the substantially planar object, wherein the signal connection is mounted to an object selected from the group consisting of the substantially planar object and the support unit.

7. An apparatus comprising:

a support unit for a handheld media device, the support unit having a first surface and a second surface, the first surface is coupleable to and suspended from a substantially planar object, wherein the substantially planar object is configured for mounting in a vertical position, the second surface is sized to support the handheld media device when the handheld media device is placed thereon; and a signal connection, the signal connection receives a media signal from the handheld media device, wherein the support unit is configured with a front portion and a back portion, the back portion contains the first surface and is coupleable to the substantially planar object and the front portion is removeably coupleable with the back portion wherein the support unit is coupled to the substantially planar object, wherein the signal connection utilizes an audio output cable.

8. The apparatus of claim 7, wherein the audio output cable utilizes a 3.5 millimeter audio connector.

9. An apparatus comprising:

a support unit for a handheld media device, the support unit having a first surface and a second surface, the first surface is coupleable to and suspended from a substantially planar object, wherein the substantially planar object is configured for mounting in a vertical position, the second surface is sized to support the handheld media device when the handheld media device is placed thereon, and a signal connection, the signal connection receives a media signal from the handheld media device, wherein the support unit is configured with a front portion and a back portion, the back portion contains the first surface and is coupleable to the substantially planar object and the front portion is removeably coupleable with the back portion wherein the support unit is coupled to the substantially planar object, wherein the signal connection is a jack for a 3.5 millimeter audio connector.

10. An apparatus comprising:

a support unit for a handheld media device, the support unit having a first surface and a second surface, the first surface is coupleable to and suspended from a substantially planar object, wherein the substantially planar object is configured for mounting in a vertical position, the second surface is sized to support the handheld media device when the handheld media device is placed thereon; and a signal connection, the signal connection receives a media signal from the handheld media device, wherein the support unit is configured with a front portion and a back portion, the back portion contains the first surface and is coupleable to the substantially planar object and the front portion is removeably coupleable with the back portion wherein the support unit is coupled to the substantially planar object, further comprising:

a control circuit, the control circuit having an amplifier, a power control, and a volume control, the control circuit is electrically coupled to the signal connection, wherein the signal connection permits a handheld media device to be electrically connected to the control circuit and the control circuit allows a user to adjust amplification of a media signal from the handheld media device.

11. The apparatus of claim 10, wherein the power control and the volume control are located on the substantially planar object.

12. The apparatus of claim 11, wherein at least one of the power control and the volume control is made with a mechanism selected from the group consisting of membrane, capacitance coupling, optical sensor, push button, and rotating shaft.

13. The apparatus of claim 10, wherein the power control and the volume control are located on the support unit.

14. The apparatus of claim 13, wherein at least one of the power control and the volume control is made with a mechanism selected from the group consisting of membrane, capacitance coupling, optical sensor, push button, and rotating shaft.

15. The apparatus of claim 10, further comprising:

a speaker, wherein the control circuit permits an audio signal to be broadcast through the speaker.

16. The apparatus of claim 15, wherein the speaker is incorporated into the substantially planar object.

17. The apparatus of claim 15, wherein the speaker is attached to the substantially planar object.

18. The apparatus of claim 15, wherein the speaker is located externally from the substantially planar object.

19. The apparatus of claim 10, further comprising:

a source of light, the source of light emanates from beneath the support unit, and the control circuit provides power to the source of light.

20. The apparatus of claim 19, wherein colored light emanates from the source of light.

21. The apparatus of claim 10, further comprising:

a universal serial bus (USB) connection, the USB connection is connected to the control circuit and can provide a source of electrical power to charge a battery in a handheld media device, when the handheld media device is connected to the USB connection.

22. The apparatus of claim 10, the signal connection further comprising;

a dock, the dock is configured to receive a handheld media device and to provide electrical coupling of the handheld media device with the control circuit, wherein an audio signal path is established when the handheld media device is placed in the dock.

23. The apparatus of claim 22, wherein a video signal path is established and a video signal from the handheld media device can be displayed on a display screen.

24. The apparatus of claim 23, wherein the handheld media device's battery can be charged.

25. The apparatus of claim 23, wherein the handheld media device is selected from the group consisting of an Apple® iPod®, an Apple® iPhone®, a Microsoft® Zune®, an MP3 device.

26. The apparatus of claim 22, the control circuit further comprising:

a video control for controlling a video signal.

27. The apparatus of claim 26, further comprising:

a display screen, the display screen is incorporated into the substantially planar object and the video signal can be displayed on the display screen when the handheld media device is placed in the dock.

28. The apparatus of claim 10, further comprising:

a groove, wherein the groove is located in the second surface, and groove is sized to receive the handheld media device.

29. The apparatus of claim 10, further comprising:

a speaker, the speaker is electrically coupled to the control circuit; and an electrical power source, the electrical power source is electrically connected with the control circuit, the control circuit together with the electrical power source and a media signal from the handheld media device can be used to play sound from the speaker.

30. The apparatus of claim 29, wherein the substantially planar object is mounted on a vertical surface.

31. The apparatus of claim 29, wherein the control circuit can be used to charge a battery in the handheld media device.

32. The apparatus of claim 29, further comprising;

a power control, wherein the power control can be used to connect or disconnect the electrical power source from the control circuit.

33. The apparatus of claim 29, wherein the signal connection is provided in the substantially planar object.

34. The apparatus of claim 29, wherein the signal connection is provided in the support unit.

* * * * *